US007469737B2

(12) United States Patent
Mullet et al.

(10) Patent No.: US 7,469,737 B2
(45) Date of Patent: Dec. 30, 2008

(54) SUPPORT SYSTEM FOR A SECTIONAL DOOR

(75) Inventors: Willis J. Mullet, Gulf Breeze, FL (US); Allen C. McDowell, Blue Springs, MS (US)

(73) Assignee: Wayne-Dalton Corp., Mt. Hope, OH (US)

( * ) Notice: Subject to any disclaimer, the term of this patent is extended or adjusted under 35 U.S.C. 154(b) by 391 days.

(21) Appl. No.: 11/493,689

(22) Filed: Jul. 25, 2006

(65) Prior Publication Data

US 2008/0023159 A1 Jan. 31, 2008

(51) Int. Cl.
*E05D 15/00* (2006.01)

(52) U.S. Cl. ..... 160/201; 160/188; 292/36; 292/28; 292/38; 292/125; 292/171

(58) Field of Classification Search ..... 160/188, 160/201; 292/36, 28, 38, 125, 171
See application file for complete search history.

(56) References Cited

U.S. PATENT DOCUMENTS

| | | | | | |
|---|---|---|---|---|---|
| 1,530,762 | A | | 3/1925 | Dautrick | |
| 1,990,870 | A | | 2/1935 | Kelly | |
| 3,443,625 | A | * | 5/1969 | Moser et al. | 160/181 |
| 3,635,277 | A | | 1/1972 | Bahnsen | 160/191 |
| 3,834,747 | A | * | 9/1974 | Slovensky, Jr. | 292/38 |
| 4,055,024 | A | | 10/1977 | Frank | 49/153 |
| 4,065,900 | A | | 1/1978 | Eggert | 52/476 |
| 4,069,641 | A | | 1/1978 | DeZutter | 52/202 |
| 4,083,156 | A | | 4/1978 | Tye | 52/127 |
| 4,194,549 | A | | 3/1980 | Lovgren | 160/84 R |
| 4,460,030 | A | * | 7/1984 | Tsunemura et al. | 160/35 |
| 4,467,853 | A | | 8/1984 | Downey, Jr. | 160/133 |
| 4,478,268 | A | | 10/1984 | Palmer | 160/310 |
| 4,601,320 | A | | 7/1986 | Taylor | 160/271 |
| 4,611,848 | A | | 9/1986 | Romano | 296/98 |
| 4,827,667 | A | * | 5/1989 | Jarvis | 49/280 |
| 4,872,634 | A | | 10/1989 | Gillaspy et al. | 248/354 |
| 4,884,831 | A | * | 12/1989 | Emon | 292/38 |
| 4,934,439 | A | | 6/1990 | Martin | 160/201 |
| 5,001,861 | A | * | 3/1991 | Hahn | 49/280 |
| 5,383,509 | A | | 1/1995 | Gaffney et al. | 160/209 |
| 5,445,207 | A | * | 8/1995 | Romanelli et al. | 160/209 |
| 5,509,233 | A | * | 4/1996 | Peterson | 49/139 |
| 5,544,924 | A | * | 8/1996 | Paster | 292/6 |
| 5,584,332 | A | | 12/1996 | Miller | 160/201 |
| 5,620,038 | A | | 4/1997 | DeCola et al. | 160/209 |
| 5,657,805 | A | | 8/1997 | Magro | 160/133 |

(Continued)

*Primary Examiner*—Katherine W Mitchell
*Assistant Examiner*—Philip S Kwon
(74) *Attorney, Agent, or Firm*—Renner Kenner Greive Bobak Taylor & Weber

(57) ABSTRACT

A door system is provided for a door opening defined by a pair of vertically spaced jambs, a header positioned near the vertical extremity of the jambs, and a floor supporting the jambs. The door system includes a door, a plurality of track sections, the door being movable on the track sections, and a support system coupled to the door. Engagement of the support system when the door is in a closed position enables transfer of forces applied to the door at least to one of the header and the floor. One embodiment provides for automatic actuation of the support system by movement of a pivoting motor assembly to a closed position. Another embodiment provides for manual actuation of the support system.

9 Claims, 16 Drawing Sheets

U.S. PATENT DOCUMENTS 5,732,758 A * 3/1998 Marko ..... 160/201
5,819,834 A * 10/1998 Wedekind ..... 160/209
5,967,216 A * 10/1999 Mancini ..... 160/209
6,053,235 A * 4/2000 Ruffner, Sr. ..... 160/89
6,082,431 A 7/2000 Decola ..... 160/209
6,253,824 B1 * 7/2001 Mullet et al. ..... 160/188
6,385,916 B1 * 5/2002 Marko ..... 52/127.2
6,463,988 B1 * 10/2002 Mullet et al. ..... 160/201
6,776,210 B2 * 8/2004 Wells ..... 160/209
6,782,662 B2 * 8/2004 McCartney et al. ..... 49/197
6,796,361 B1 * 9/2004 Campbell et al. ..... 160/209
6,994,144 B2 * 2/2006 Fletcher ..... 160/209
7,059,379 B2 * 6/2006 Lewis et al. ..... 160/191
7,061,197 B1 * 6/2006 Mullet et al. ..... 318/466
7,086,443 B2 * 8/2006 Williams ..... 160/209
7,254,918 B2 * 8/2007 Fronz et al. ..... 49/122
7,282,883 B2 * 10/2007 Mullet et al. ..... 318/600
RE40,001 E * 1/2008 Siegler et al. ..... 49/199
7,367,160 B2 * 5/2008 Mullet et al. ..... 49/199
2003/0205338 A1 * 11/2003 Mullet et al. ..... 160/188
2006/0289129 A1 * 12/2006 Mullet et al. ..... 160/201
2008/0127561 A1 * 6/2008 Mullet et al. ..... 49/200
2008/0148790 A1 * 6/2008 Friese et al. ..... 70/101

* cited by examiner

SUPPORT SYSTEM FOR A SECTIONAL DOOR

TECHNICAL FIELD

In general, the present invention relates to a support system that transmits wind forces applied to a sectional door to the door's supporting structure. More particularly, the present invention relates to a support system that includes a flexible support member that extends vertically adjacent a door, wherein one end of the support member attaches to a header of the door frame and an opposite end of the support member attaches to the floor, and wherein the support system interconnects with the door to provide support thereto.

BACKGROUND OF THE INVENTION

Weather conditions cause considerable damage to buildings and other structures. A common source of damage is windloads created during storms or other weather events. As a result, efforts have been made to strengthen structures to prevent damage. Since garage doors, unlike the walls of a building, are unsupported over large spans, these doors and other similar movable barriers have been identified as a possible component of a structure that, if strengthened, could reduce damage to the structure.

To address this problem, reinforced door designs have been made. In general, these designs seek to stiffen the door by providing a thicker door or adding beams and struts positioned on the door, usually horizontally, such that, the stresses created by wind velocity pressures are transmitted to the beams and struts. Typically, these beams and struts are made of solid wood members or channel-like steel members. The weight of the beams and struts along with the components necessary to mount them often double or triple the weight of a non-windloaded door. As will be appreciated, the additional beams and struts also add considerable cost. As a result of the door's increased weight, additional strength must be added to the other components of the door system, such as the counterbalance springs, the guide tracks, and the rollers. Moreover, the door support structure must be capable of supporting the additional weight. Finally, the additional weight makes the entire door system more cumbersome and difficult to install. While a single installer can ordinarily install a non-windload door, a door reinforced with beams and struts typically requires at least two installers because of the added weight.

Aside from the increased weight, the beams and struts protrude inward from the door taking up space inside of the garage and requiring additional clearance for opening and closing of the door. This additional clearance reduces the usable length and head room of the structure making it difficult, for example, to park larger vehicles, such as sport utility vehicles within the structure.

In terms of aesthetics, the beams and struts detract from the appearance of the door and the structure.

Another door design used to deal with windloads incorporates "windlocks." Windlocks are locking devices located on a portion of a door section or panel that can either ride in or lock the door to the track system or lock the door to a supporting jamb when the door is closed. In this way, the windlocks transfer stresses generated by wind velocity pressure to the jamb or structure. If reinforcing beams or struts are also added to the door, the stresses will be more generally distributed about the door and the supporting jamb Windlocks are commonly used in rolling doors because a rolling door storage means prevents the adding of sufficient strength by using beams or struts. A rolling door uses a section or slat profile that has a male edge and a female edge that form a continuous hinge along the width of the door. This hinge has a thickness of at least two facers and provides an amount of stiffness to the sections or slats. Windlocks can be added at the end of these sections or slats to improve the door's resistance to wind velocity pressures by transmitting the stresses on the continuous hinge area to the ends of the sections and through the windlocks to the supporting guide system and finally to the jamb or building structure. These windlocks are larger in cross section than the slats and, when the door deflects from high wind velocity pressures, the windlocks are designed to engage the track in which the slats are received. When storing a rolling door equipped with windlocks, additional room is needed because of the depth of the windlock relative to that of the slats. As a result, the stored door has an increased diameter and takes up additional interior space. In these designs, clearance between the windlock and the track must be provided to prevent the windlocks from jamming door travel and care must be taken when operating the door in wind because the windlocks will jam as the door deflects. Normally, rolling door sections are 2 to 6 inches high with a large number of hinges and windlocks being necessary for a 7 to 8 foot garage door. As a result, accurate alignment of the windlocks must be made to prevent them from unintentionally striking the track system or affecting operation of the door. Improper alignment can also cause the rolling door to jam and prevent the door from operating properly. Any damage to the slats or sections caused by misalignment can also prevent the door from closing properly.

Windload systems using windlocks or horizontal reinforcement members that transfer forces to the jambs or building structure are limited in the amount of wind velocity pressure they can withstand. While the horizontal support decreases the vertical span, the strength of the door is still limited by the horizontal span. More recent prior art designs use vertical reinforcing posts to improve wind resistence by dividing the horizontal span and transferring a portion of the load to floor and the header above the door. In contrast to the horizontal support designs, the vertical support designs keep the door rigid rather than flexible under forces from the wind and transmit stresses that are parallel to the direction of the wind. Although these reinforcing post designs are always active, they add noise during the movement cycles and they suffer the same weight and clearance disadvantages of using beams and struts as mentioned above. Moreover, these permanently attached reinforcing posts add unsupported weight to the door when the door is in the open or horizontal position making it necessary to use horizontal supports on the door to prevent it from sagging.

Overall, with the exception of rolling doors, the windload design efforts have been directed at making the door sections in the door as stiff or rigid as possible with either horizontal or vertical supports. Generally, the stress transmitted to the jambs or building structure run parallel to the direction of the wind and have been known to cause a door to deflect. If the door deflects more than 6 to 8 inches under wind velocity pressure, the door likely will buckle and no longer be useable. As a result, existing design work has focused on this deflection limit as a basis to establish adequate door strength or stiffness.

In view of the shortcomings noted above in regard to use of additional beams and struts, and wind lock configurations, it is evident that there is a need in the art for a door support system which is minimal in weight, allows the door to function in a normal or close-to-normal operating manner. It will further be appreciated that there is a need for restraining the sections of a sectional overhead door that will keep the door sections in tension when exposed to wind velocity pressures when the door is closed as a means of distributing forces to prevent premature buckling of the sections. It will also be appreciated that the structure and associated method for restraining the sections needs to be quick and easily installed and can be active at all times when the door is closed.

SUMMARY OF THE INVENTION

In light of the foregoing, it is a first aspect of the present invention to provide a support system for a sectional door.

It is another aspect of the present invention is a door system for a door opening defined by a pair of vertically spaced jambs, a header positioned near the vertical extremity of the jambs, and a floor supporting the jambs, the door system comprising a door, a plurality of track sections, the door being movable on the track sections, and a support system coupled to the door, wherein engagement of the support system when the door is in a closed position enables transfer of forces applied to the door at least to one of the header and the floor.

Still another aspect of the present invention is a method for operating a support system for a door that is moveable between open and closed positions with respect to a door opening, wherein the door opening is formed by a floor that supports a frame that provides a header substantially opposite the door, the method comprising providing a header attachment assembly associated with an upper portion of the door and a floor attachment assembly associated with a lower portion of the door, associating the header attachment assembly with the floor attachment assembly, and engaging one of the header and the floor assemblies so as to engage a support system to couple the door to at least one of the frame and the floor.

BRIEF DESCRIPTION OF THE DRAWINGS

For a complete understanding of the objects, techniques and structure of the invention, reference should be made to the following detailed description and accompanying drawings, wherein.

DETAILED DESCRIPTION OF THE INVENTION

Figure 1:
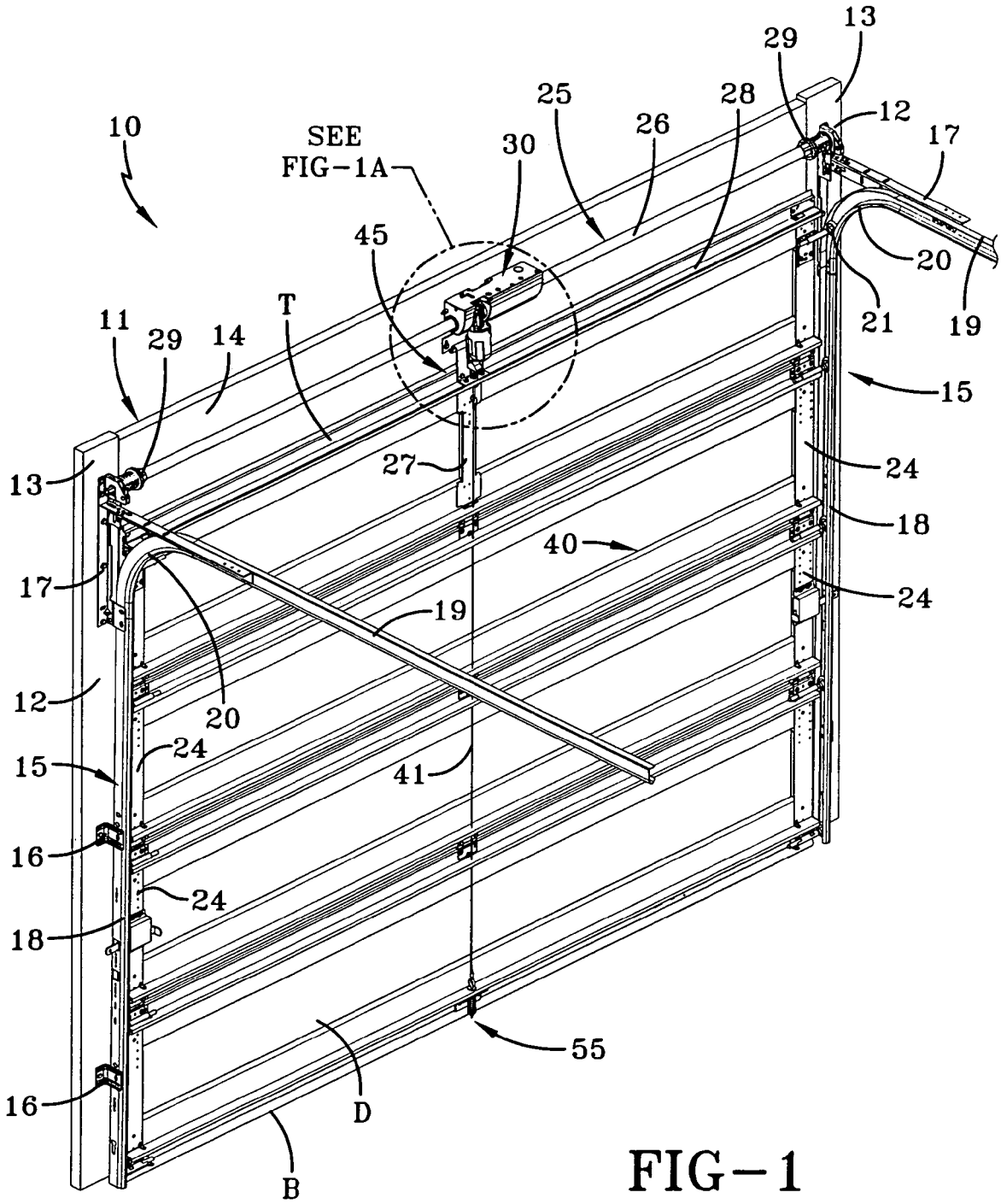
FIG. 1 is a rear perspective view of a door system having a door frame made up of a pair of vertically extending jambs and a horizontally extending header located between the jambs, a pair of guide tracks supported on the jambs moveably supporting a sectional door thereon, a counterbalance assembly mounted on the header and operatively connected to the door, an operator assembly having a pivoting motor assembly shown in a downward extending lock position, and a support system according to the concepts of the present invention.

A door system according to the concepts of the present invention is generally designated by the numeral 10 in the accompanying drawings and specifically FIGS. 1-5. Door system 10, generally includes a door frame, generally indicated by the numeral 11, having a pair of vertically extending jambs 12 and a horizontally extending header 14 which may connect the vertical upper extremities 13 of jambs 12.

A pair of track assemblies, generally indicated by the numeral 15 are supported on the jambs 12, as by brackets 16 and a flag angle 17. Each track assembly 15 includes a generally vertical track section 18 and a horizontal track section 19 connected to each other by a curved transition section 20. Track assemblies 15 are generally channel-like members that open inwardly to receive rollers 21 mounted on a door D that is movable along the track assemblies 15.

Figure 1A:
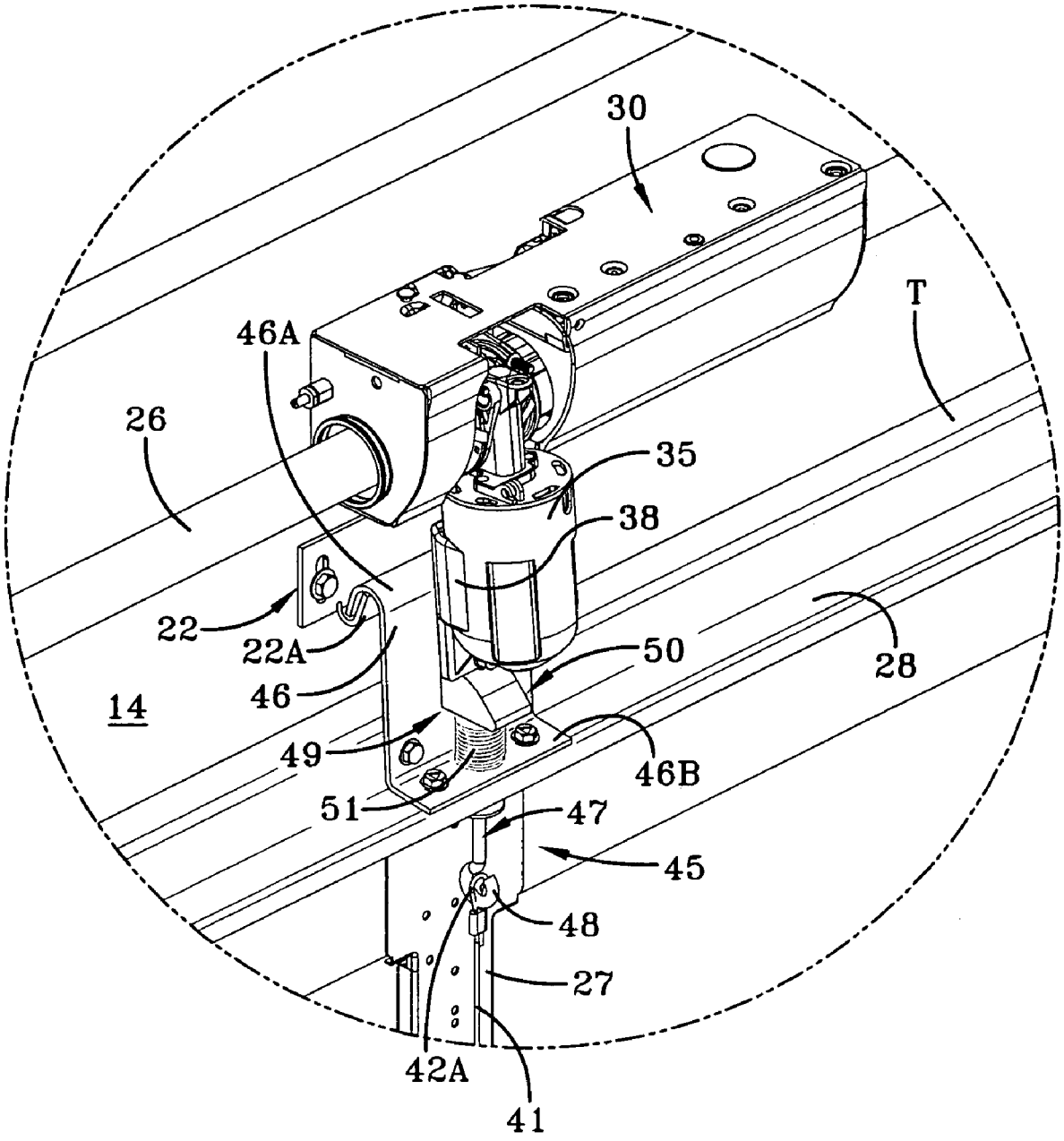
FIG. 1A is an enlarged rear perspective view of the area circled in FIG. 1 depicting further details of the operator and door support system including engagement of a header attachment assembly on the support system when the pivoting motor assembly is in the lock position.
Figure 2:
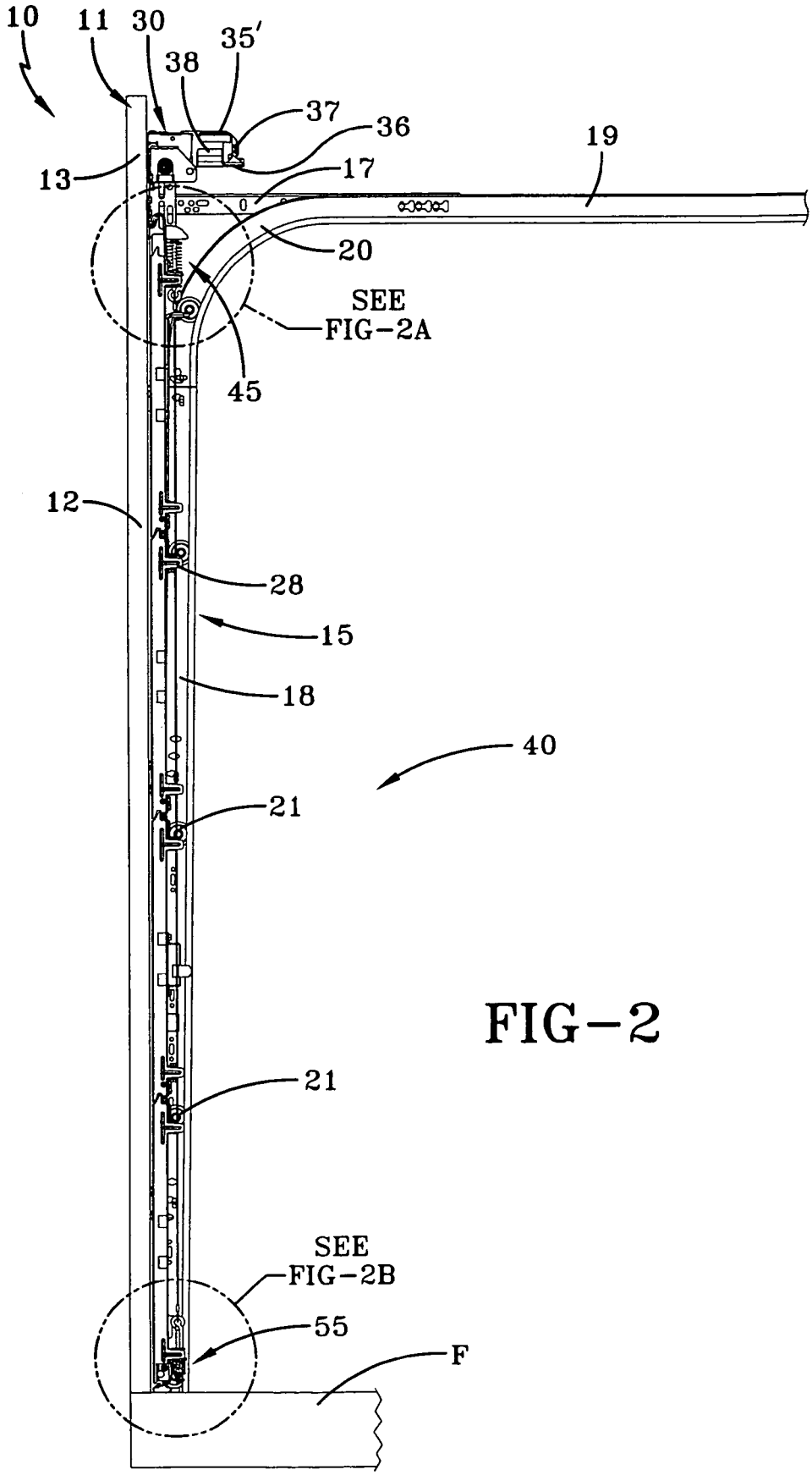
FIG. 2 is a side elevational view sectioned to show the door system with the pivoting motor assembly in a horizontally extending unlocked position.
Figure 2A:
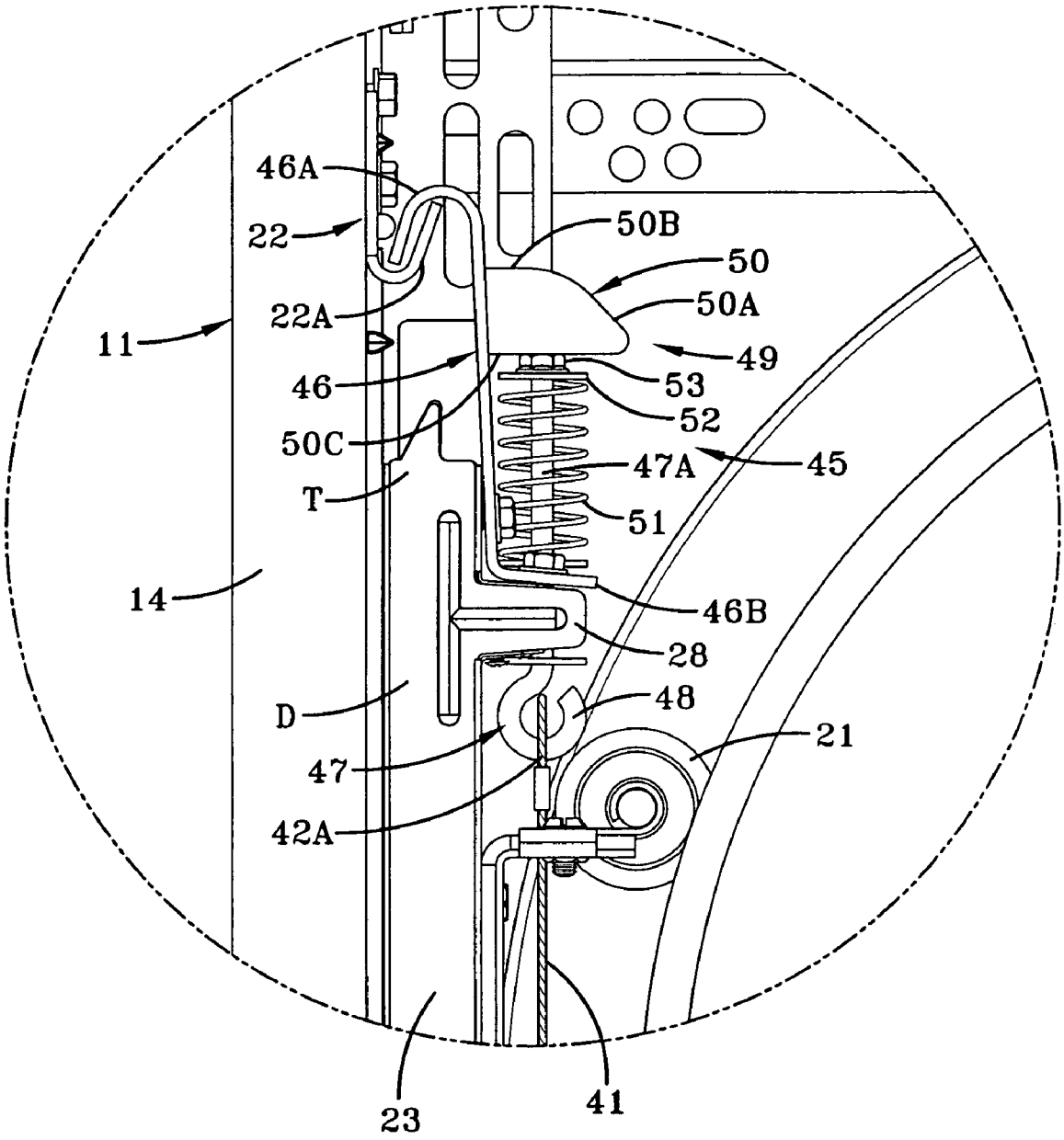
FIG. 2A is an enlarged view of the area circled in FIG. 2 depicting the header attachment assembly in a disengaged position.

A catch 22, which is best seen in FIGS. 1A and 2A, is a plate-like member mounted to the header 14 by bolts or other fastening type devices. An elongated, upwardly projecting lateral hook 22A extends outwardly from a bottom edge of the plate-like member. The purpose of the catch 22 will become evident as the description proceeds.

Figure 3:
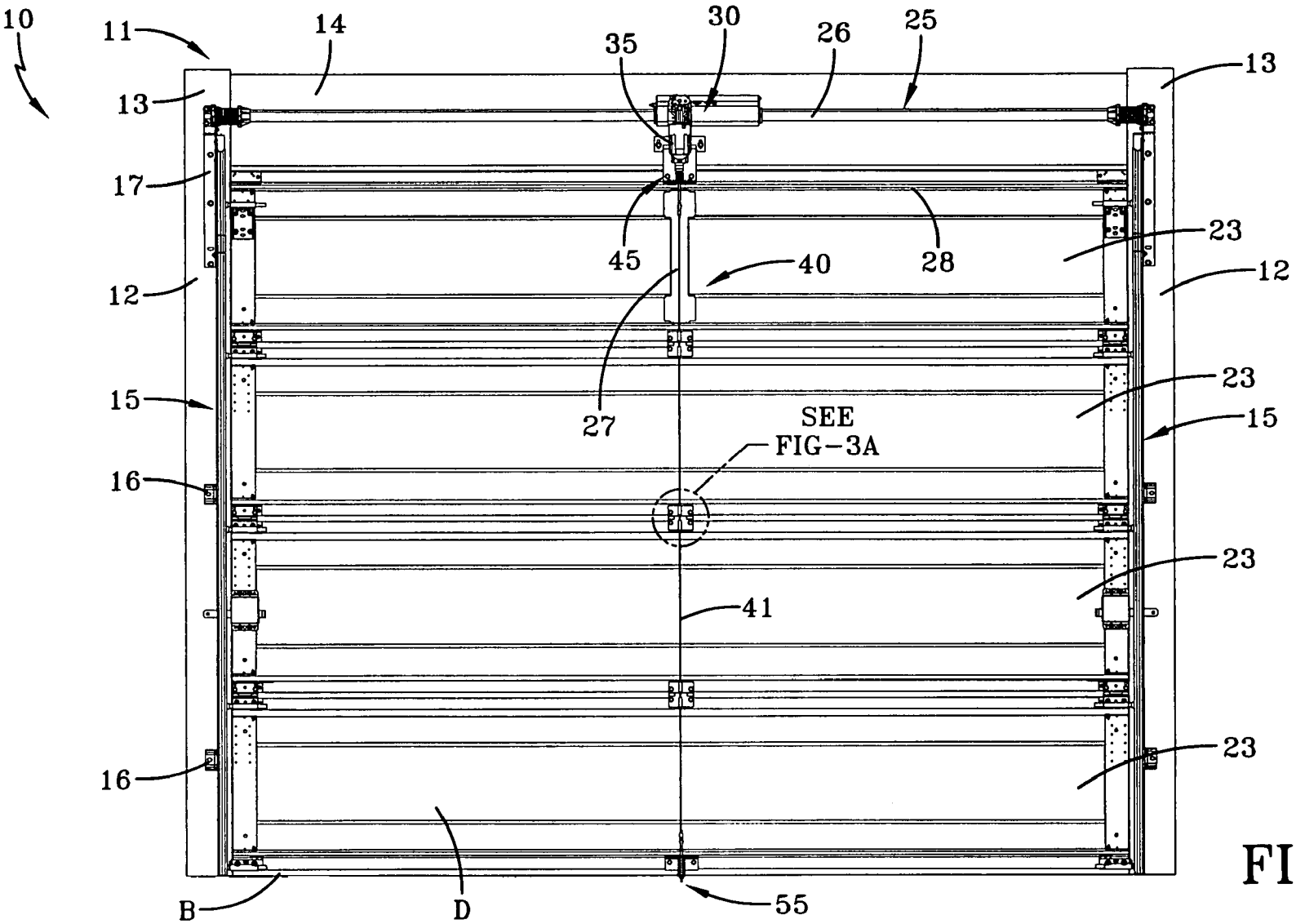
FIG. 3 is a rear elevational view of the door system depicted in FIG. 1.
Figure 3A:
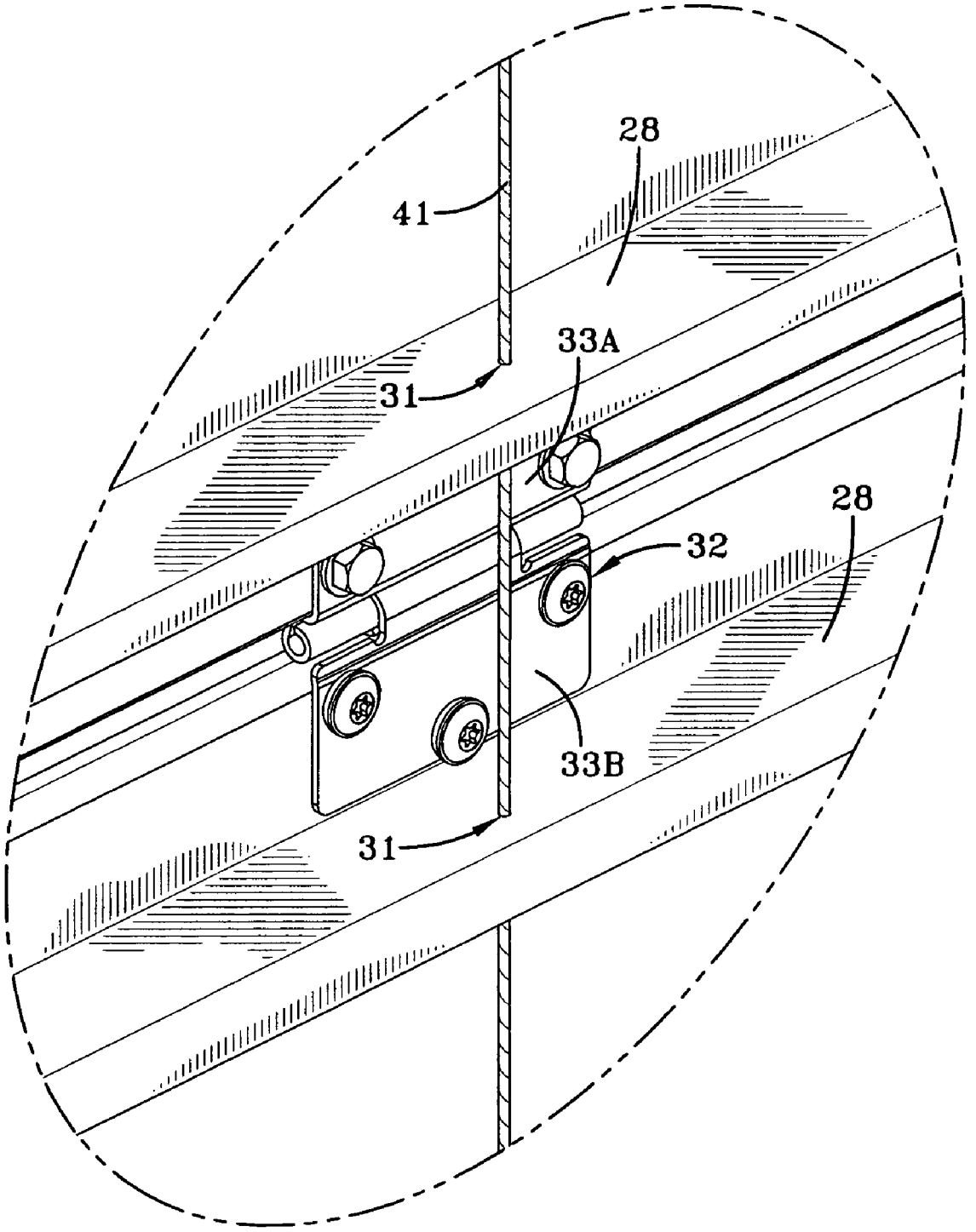
FIG. 3A is an enlarged perspective view of the area circled in FIG. 3 depicting the details of the support member passing through struts of the sectional door.

As shown, the door D may be a sectional door having a plurality of sections 23 that are pivotally attached to each other by way of hinges or other similar mechanisms. In this way, as the door D is moved from a generally vertical closed position to a generally horizontal open position (not shown), sections 23 pivot relative to each other as they move through the transition section 21 of track assemblies 15. Each door section 23 may be provided with an outer stile 24 that may or may not structurally reinforce the outer vertical edges of the respective section 23. Further reinforcement may be provided in the form of a strut 28 which horizontally extends between the stiles of each section 23. Typically, each strut 28 is located at a top and/or bottom inwardly facing surface of a door section. At a minimum, an uppermost section 23 requires a medially disposed strut-like projection at a top surface edge thereof. And, if desired, a center stile 27, medially disposed between the outer stiles 24, may extend between the top and bottom inwardly facing surface edges and/or struts of each section 23. Each strut 28 may have an aperture 31 therethrough as best seen in FIG. 3A. A medial hinge 32, which can be seen in detail in FIG. 3A, may be used to interconnect adjacent sections 23 to one another. The hinge 32 has one leaf 33A secured to a lower surface of one section 23 or the associated strut and another leaf 33B secured to an upper surface of an adjacent section or the associated strut. The leafs 33 may be interconnected with one another by a pin or other mating configuration to facilitate movement of the sections.

A counterbalance assembly, generally indicated by the numeral 25, is provided to counterbalance the weight of the door D and facilitate opening and closing thereof. Although not shown in detail, a skilled artisan will appreciate that the counterbalance assembly includes a rotatable counterbalance tube 26 which has a cable storage drum 29 at at least one end. A lift cable (not shown) is attached at one end to a bottom door section and at an opposite end to the storage drum. As the door is raised and lowered, the lift cable is reeled in or payed out from the drum. An exemplary counterbalance system is disclosed in U.S. Pat. No. 5,419,010, and is incorporated herein by reference.

To further facilitate opening and closing of the door D, a motorized operator, generally indicated by the numeral 30 is mountably supported by the header 14 and interconnects with the door D through the counterbalance system and raises and lowers the door D. The motorized operator 30 may be controlled by wired or wireless transmitters as is well understood in the art.

As best shown in FIG. 1A, the operator 30 may be a jack shaft type operator connected directly to the tube 26 of counterbalance assembly 25. The operator 30 may further include a pivoting motor assembly, generally indicated by the numeral 35. An exemplary pivoting motor assembly used with a sectional barrier is disclosed in U.S. Pat. No. 6,561,255 which is incorporated herein by reference. As shown, motor assembly 35 is aligned with the medially disposed strut-like projection if provided. In any event, the assembly 35 pivots to a downwardly extending lock position (FIG. 1A), where the motor assembly 35 may impede or otherwise interfere with opening of the door D by impeding movement of the uppermost section 23. As the operator 30 raises door D, the motor assembly 35 pivots upward to an unlocked position 35' (FIG. 2). The motor assembly 35 may be provided with an extension 36 that projects toward a top edge of an uppermost door section. As shown, extension 36 may be a flange that extends axially outward of an end 37 of motor assembly 35. Extension 36 may be formed as part of the motor assembly 35, or, as shown, it may be separately attached thereto. In the example shown, extension 36 includes a pair of arms 38 (one shown) that are shaped to generally conform to the motor assembly 35 and may permit a snap-type attachment of the extension 36 to the motor assembly 35 without additional fasteners. The extension 36 may, however, be attached in any manner.

A support system, designated generally by the numeral 40, is associated with the door system 10 for the purpose of providing substantially vertical support to a sectional overhead garage door for increasing the ability of the door to transmit the stresses and other forces generated by high velocity wind pressures while still allowing some flexible movement of the sections. As will be specifically detailed, when the motor assembly 35 is in a locking position, the support system is engaged and provides vertical stability to the door. Indeed, the pivoting motor assembly 35 functions to selectively release or engage the door support system upon opening or closing of the door D.

Door support system 40 includes a generally elongated flexible support member 41 that extends generally from a top of the uppermost section 23 to a bottom lowermost section. The support member 41 may be a flexible, plastic encapsulated steel cable, such as the cable depicted in the figures. Of course, other types of cables which consist of polymeric strength members such as Vectran® or Kevlar® or combinations thereof with metallic constituents may be employed. The support member 41 extends generally vertically and is substantially perpendicular in relation to the floor F. Each end of the support member 41 is folded over itself and crimped or otherwise secured so as to form a loop 42A and a loop 42B at a respective top and bottom thereof. The support member 41 may be slidably received through the strut apertures 31. It will be appreciated that the apertures are sized to allow retained slidable movement of the member and the member is received in such a manner that the member does not interfere with normal opening and closing movement of the door. In the alternative, or additionally, each leaf 33 may be configured to slidably retain the support member 41.

The support system 40 includes a header attachment assembly positioned near the top of the uppermost section and generally indicated by the numeral 45, and a floor attachment assembly generally indicated by the numeral 55 and positioned near the bottom of the lowermost section.

Figure 4:
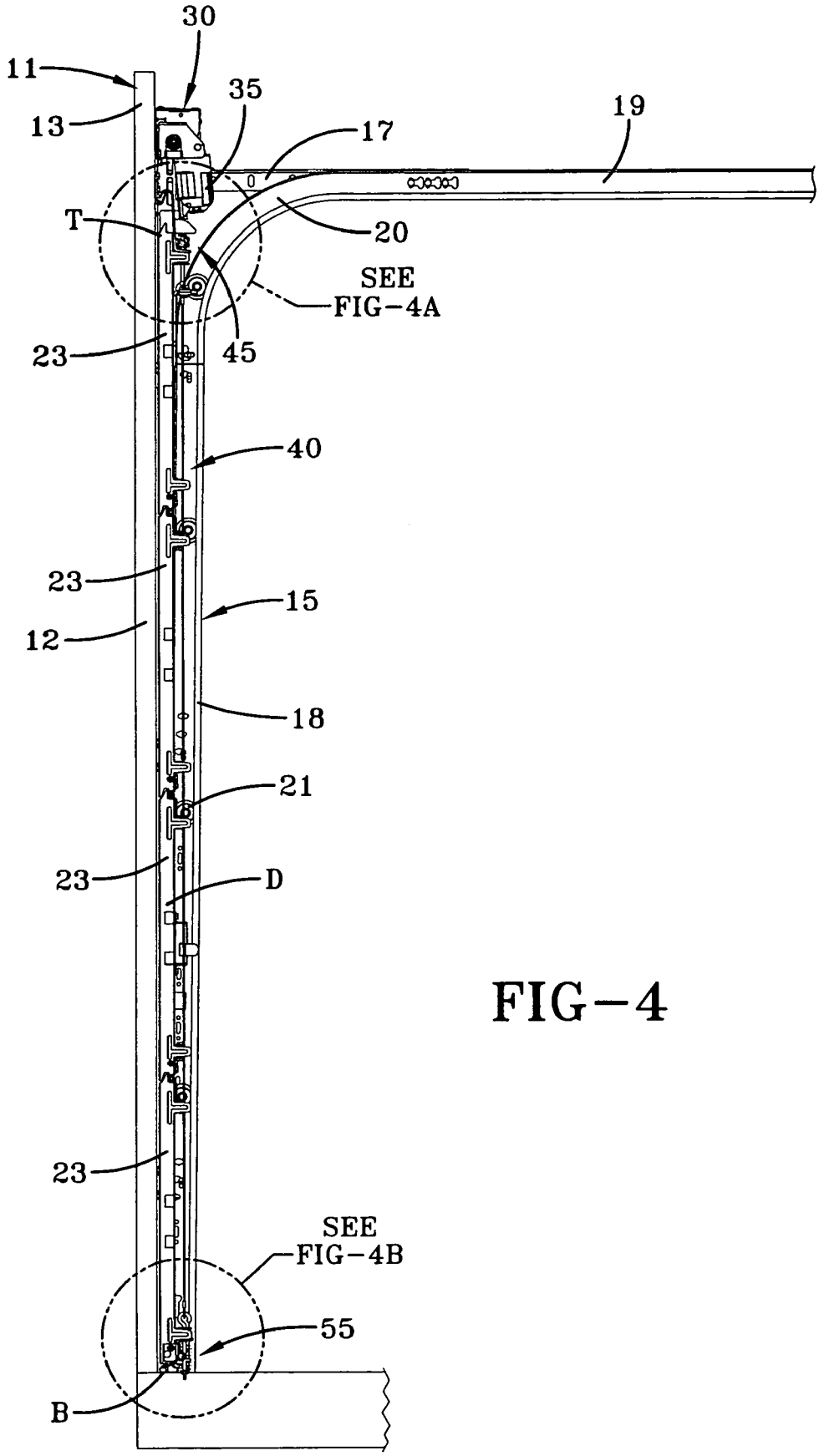
FIG. 4 is a side elevational view sectioned to show the door system with the pivoting motor assembly in a downward extending lock position.
Figure 4A:
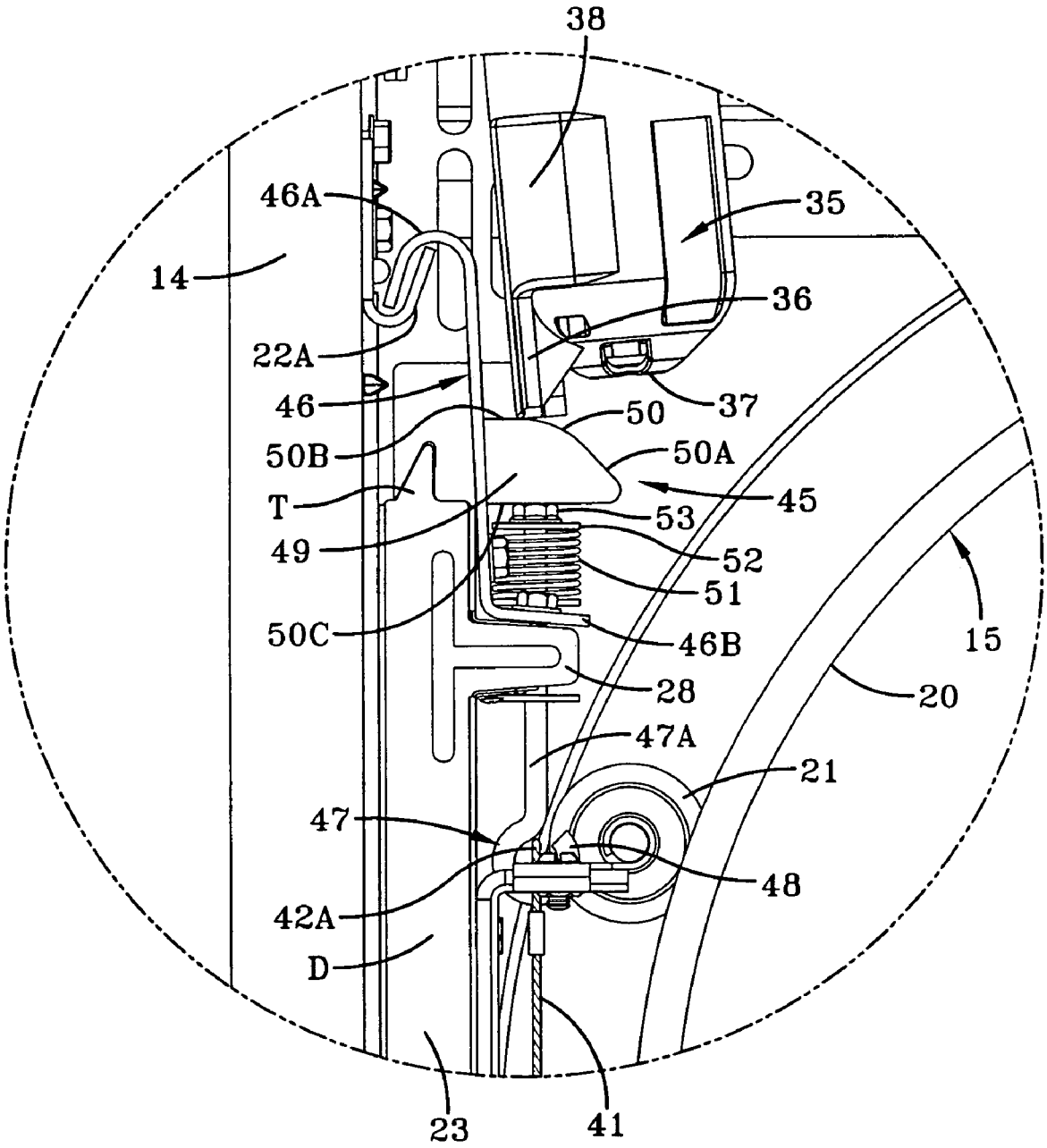
FIG. 4A is an enlarged side elevational view of the area circled in FIG. 4 depicting the header attachment assembly in an engaged position.

As best shown in FIG. 4A, header attachment assembly 45 includes a bracket 46 that has one end supported on the door, and may, as shown, mount on a horizontally extending strut 28 located near the uppermost section of the door D. The bracket 46 nests with the catch 22 when the door reaches the vertical closed position (FIG. 1). Indeed, the bracket 46 includes an elongated downwardly projecting lateral hook 46A that extends from an end opposite a bracket end 46B mounted to the strut 28 or an inside surface of a top portion of the uppermost door section. Specifically, the hook 46A nests with the hook 22A mounted on frame 11. As shown, the hook 46A and hook 22A are oriented in opposite directions so that, when the door D is closed and the header attachment assembly is engaged, the hooks 46A, 22A engage or otherwise mate with each other in an overlapping fashion to resist loads acting on the door in the forward and rearward directions.

The header attachment assembly 45 further includes a header eyebolt 47 which has a shaft 47A that extends through a bore (not shown) formed in the bracket end 46B and/or the strut 28, as shown. At its lower extremity, header eyebolt 47 includes an eyelet 48 that is disposed on a lower side of the upper strut of the uppermost door section. The eyelet 48 receives and is coupled to the top loop 42A of the flexible support member 41. Secured to an opposite end of the header eyebolt 47 is a latch cam 49. As best shown in FIGS. 2A and 4A, the latch cam 49 has a profiled upper surface 50 adapted to interact with the motor assembly 35 to downwardly displace the eyebolt 47 when the motor assembly 35 moves into the lock position (FIG. 1A). For example, the upper surface 50 may have an inclined rearward portion 50A that extends upward and forward toward a generally level portion 50B, such that the extension 36 first engages the inclined portion 50A as the motor assembly pivots downward. In this way, the header eyebolt 47 is gradually displaced by contact between the motor assembly 35 and latch cam 49.

A biasing member 51 operates with the header attachment assembly 45 to urge the latch cam 49 upward toward motor assembly 35. As shown, the biasing assembly 51 is in the form of a coil spring, which may also be referred to as a cam spring, disposed around the shaft 47A and located between the strut 28 or bracket end 46B, and latch cam 49. In this embodiment, a lower surface 50C of latch cam 49 provides a suitable surface against which the biasing member may bear or be attached to. As shown, a stop 52 may be provided on the shaft 47A at an end opposite the eyelet 48. Adjustment of the biasing force of biasing member 51 may be made by adjusting the axial position of the stop 52, for example with suitable spacers or a nut 53 threadably mounted on the shaft 47A.

The biasing member 51 urges the latch cam 49 associated with or attached to the eyebolt upward toward motor assembly 35. It will be appreciated that the cam 49 slidably moves with respect to the bracket 46. In other words, the cam 49 is adjacent to and may bear against, but is not fixed to the bracket 46. Contacting of the extension 36 with the latch cam 49 as the motor assembly pivots to the locked position overcomes the biasing force of the coil spring and drives or pushes the eyebolt 47 downward. Accordingly, when the latch cam 49 is not engaged by the extension arm 36, the attached flexible support member 41 and the floor attachment assembly 55 are urged upward by biasing member 51 resulting in the floor attachment assembly 55 being retained in a disengaged position relative to the floor F of the structure, as shown in FIG. 2B, and described more completely below.

The floor attachment assembly 55 may be mounted on the door D, for example at a strut 28 near the bottom B of the lowermost section 23. In the example shown, the eyebolt 56 includes an eyelet 57 from which extends a shaft 58 that may be inserted through an enlarged aperture 31' formed in the strut 28 to slidably retain the shaft. The support member 41 is connected to the eyebolt 56. Specifically, the loop 42B is received by the eyelet 57.

A second biasing member 60 is carried by the eyebolt 56 and provided to urge the shaft 58 toward engagement with the floor F. In the example shown, biasing member is a coil spring mounted between an underside of the strut 28 and an end 61 of the shaft 58. The end 61 is opposite the eyelet 58 and is threaded. Specifically, a radially outward extending stop 62 may be retained on the shaft 58 by a nut or other comparable fastener to provide a surface against which one end of the biasing member 60 may bear in the axial direction. In the example shown, the end 61 of the shaft 59 is threaded and a washer and nut are used to provide the stop 62. Use of a washer and nut allow adjustment of the biasing force in a manner as described with respect to the header attachment assembly 45.

Figure 2B:
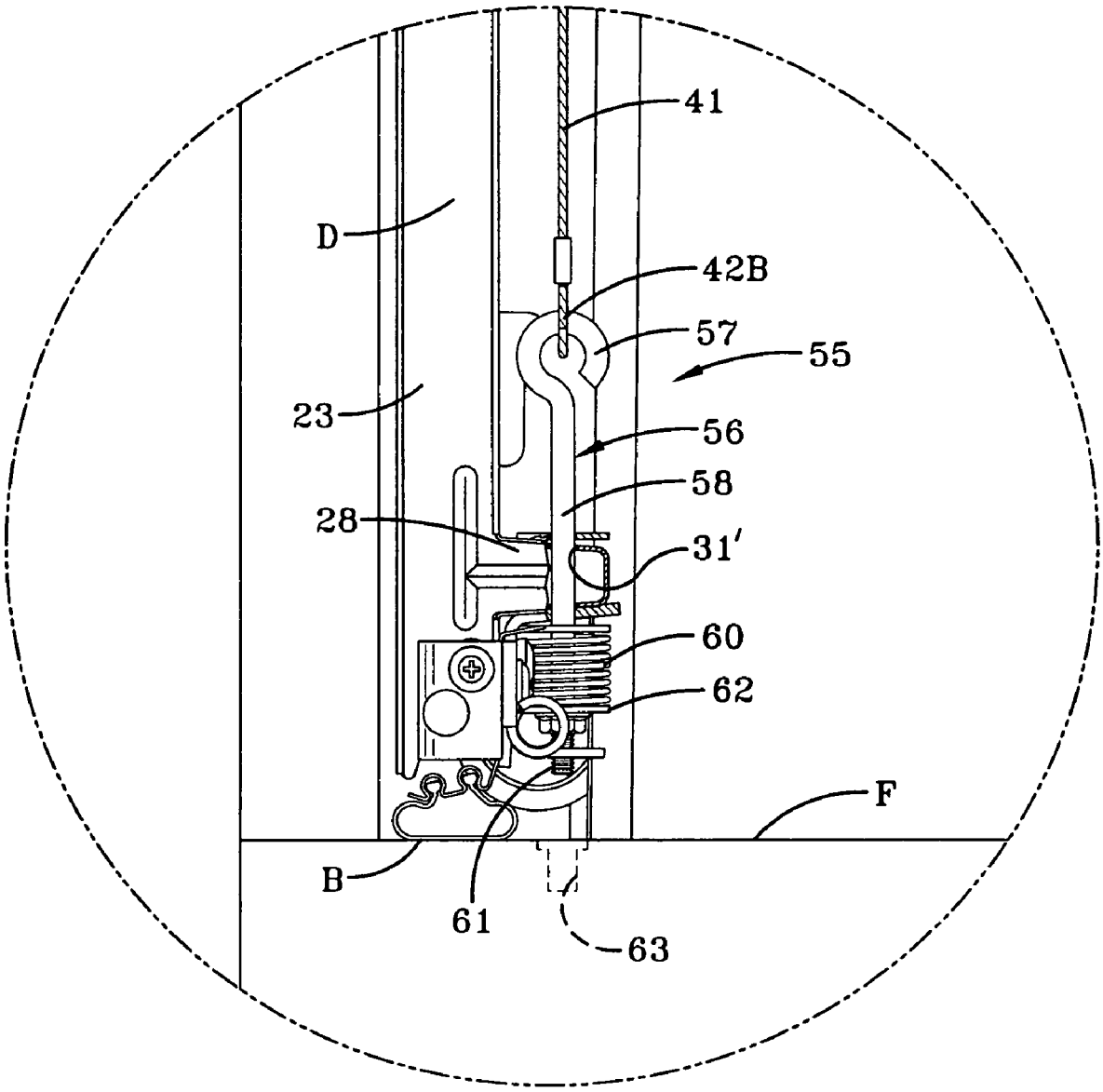
FIG. 2B is an enlarged view of the area circled in FIG. 2 depicting a floor attachment assembly in a disengaged position.

With reference to FIGS. 2A, 2B, 4A and 4B, automatic operation of the support system 40 will be described. In FIGS. 2A and 2B, the support system 40 is in a disengaged or released position, where the floor attachment assembly 55 is disengaged from the floor F. In this position, the header attachment assembly 45 and specifically the latch cam 49 is biased upwardly by the biasing member 51. The spring force of the biasing member 51 is selected so that it easily overcomes the spring force of the biasing member 60. As a result, the floor attachment assembly 55 and, in particular, the stop 62 is pulled upward and compresses the second biasing member 60. As best shown in FIG. 2B, in this configuration, the end 61 of floor attachment assembly 55 is disengaged from the floor F.

With the floor attachment assembly 55 disengaged, the door D may be moved upwardly in an ordinary fashion either by manual operation or by way of the operator motor assembly 35. In the embodiment shown, the operator 30 has a pivoting motor assembly 35 that rotates to a downward extending position when the door D is moved to the closed position as seen in FIGS. 1 and 1A. In this position, the motor assembly 35 performs a locking function by interfering with a manual opening of the door D. Also, when moved to this position, the motor assembly 35 engages the header attachment assembly 45, as shown in FIGS. 4 and 4A, to engage the support system 40. As shown, motor assembly 35 contacts the latch cam 49 of the header attachment assembly 45 urging it downward and compressing biasing member 51. As a result, the spring force of the first biasing member 51 is significantly reduced and the second biasing member 60 (FIG. 4B) urges the tensioned flexible member 41 and the floor attachment assembly 55, and in particular the shaft 58, downward causing it to engage the floor F. In the example shown, an end 61 of the floor eyebolt 56 is received within a bore 63 that may be formed within the floor F or provided by a receiver carried on the floor F to radially constrain the end.

Figure 4B:
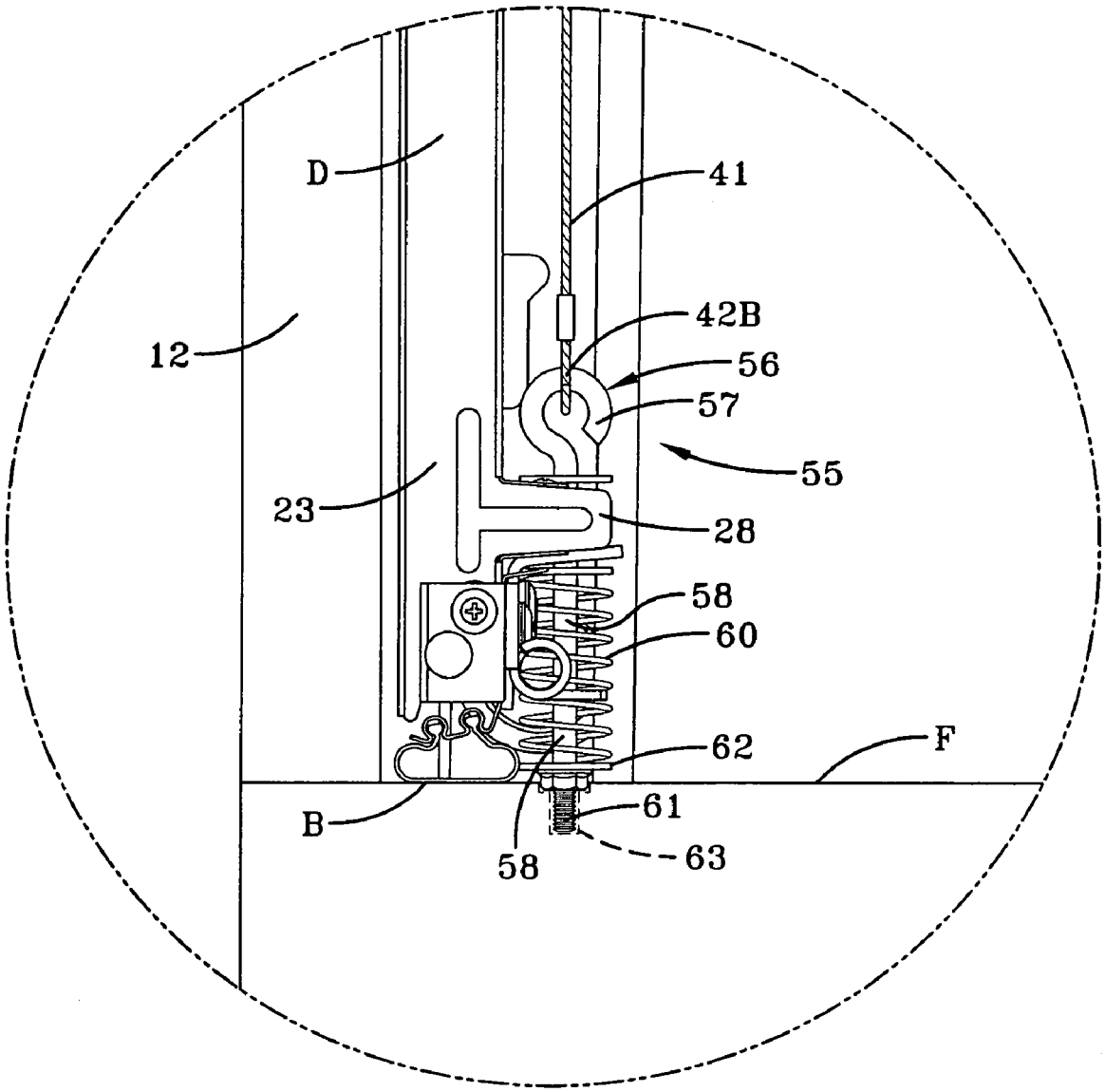
FIG. 4B is an enlarged side elevational view of the area circled in FIG. 4 depicting the floor attachment assembly in an engaged position.

As discussed above, when the door is moved to the closed position depicted in FIGS. 4A and 4B, hook 46A of the bracket 46 mounted on the top section of the door D engages the hook 22A, which is mounted to the header 14. When the motor assembly engages the latch cam, the floor attachment assembly engages the floor and, as such, the support system 40 is coupled to the frame 11 and floor F respectively. As noted previously, the flexible support member 41 is received and/or retained through the strut apertures. Accordingly, any wind forces or the like projected onto the door sections 23 are transmitted into the struts and the tracks via the rollers as in prior art door systems. In the present embodiment, forces transmitted to the struts are also transferred to the flexible support member 41, which are then transmitted through the respective attachment assemblies and into the floor and the header. In this way, the door support system 40 resists wind loads by transmitting forces at the door sections 23 through the support member 41 to the frame 14 and floor F.

It will be appreciated that an alternative support system 140 may be manually operated. In FIGS. 5-10, a manually operated support system is shown. The manually operated support system is generally indicated by the numeral 140 in FIG. 5 and is used in connection with a door system, generally indicated by the numeral 110. Door system 110, which is similar to the system 10, includes a door D, which may include a plurality of interconnected hinged sections 123. The door D is moveable with respect to a frame 111 that includes vertically extending jambs 112 connected at their upper vertical extremity 113 by a header 114. The frame 111 is supported on the floor F and related structure and defines an opening in which the door D resides. The door D is mounted on track assemblies, generally indicated by the numeral 115 that may each be attached to the jambs 112 by brackets 116 and a flag angle 117. The track assemblies 115 may include a vertical track section 118 and a horizontal track section 119 connected by a curved transition track section 120 for moving the door D from a generally vertical closed position (FIG. 5) to a generally horizontal open position (not shown). To assist in movement of the door D between these two positions, a counterbalance assembly, generally indicated by the numeral 125 may be provided. As in the previous embodiment, a counterbalance tube, a cable drum, and a lift cable may be utilized. The door D may be moved manually or by a motorized operator as shown in the previous embodiment. In the present embodiment, a pivoting operator is not required although one could be used, and as such, a jackshaft, trolley type, belt drive or any other type of motorized operator may be used.

The support system 140 includes a flexible support member 141 that extends from substantially the top of the door D to the bottom of door D. The support member 141 is constructed in much the same manner as member 41. Support system may further include a header attachment assembly, generally indicated by the numeral 145 and a floor attachment assembly, generally indicated by the numeral 155 at each respective end of the support member 141.

Figure 5:
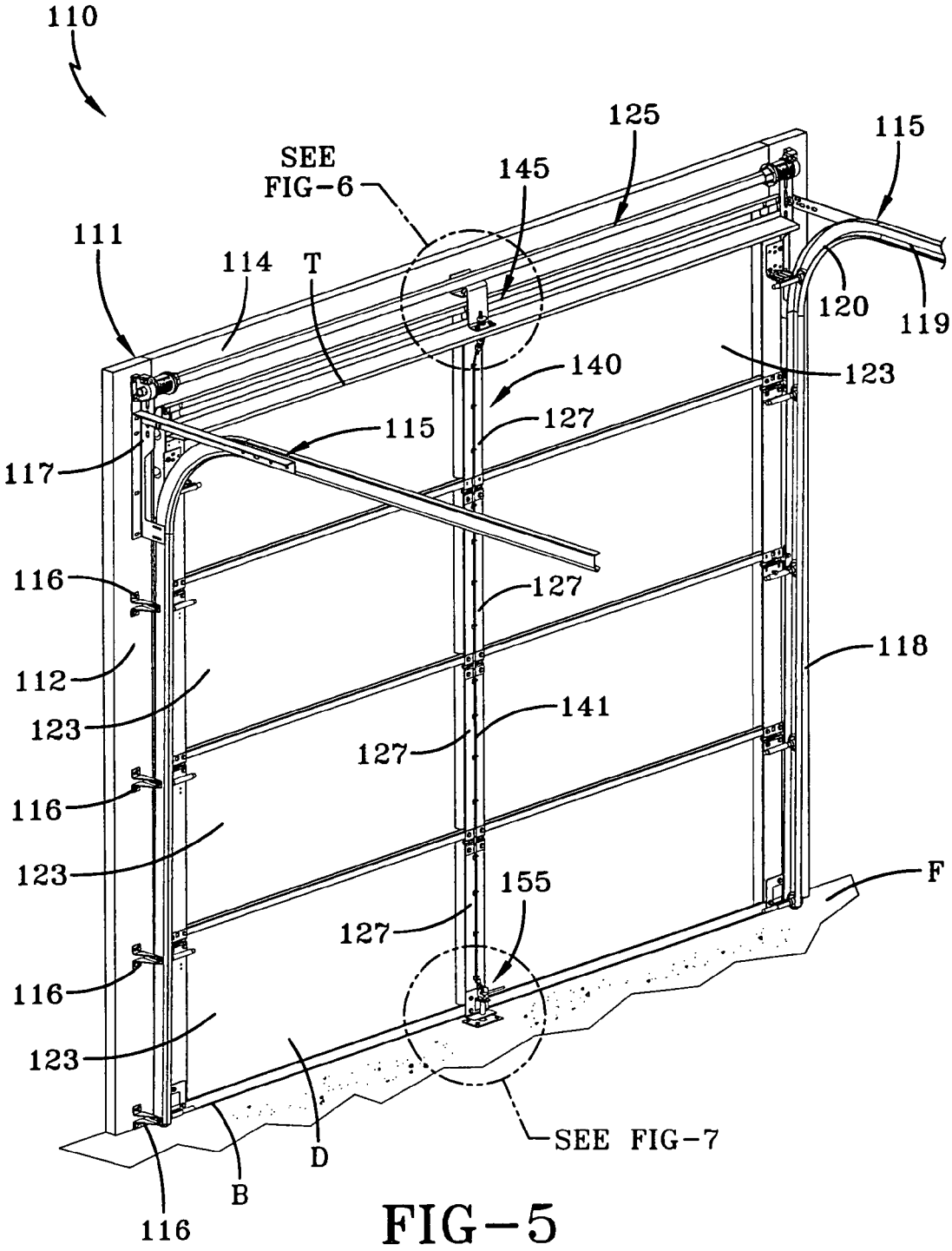
FIG. 5 is a rear elevational view of an alternate support system used in connection with a door system that does not interact with an operator.
Figure 6:
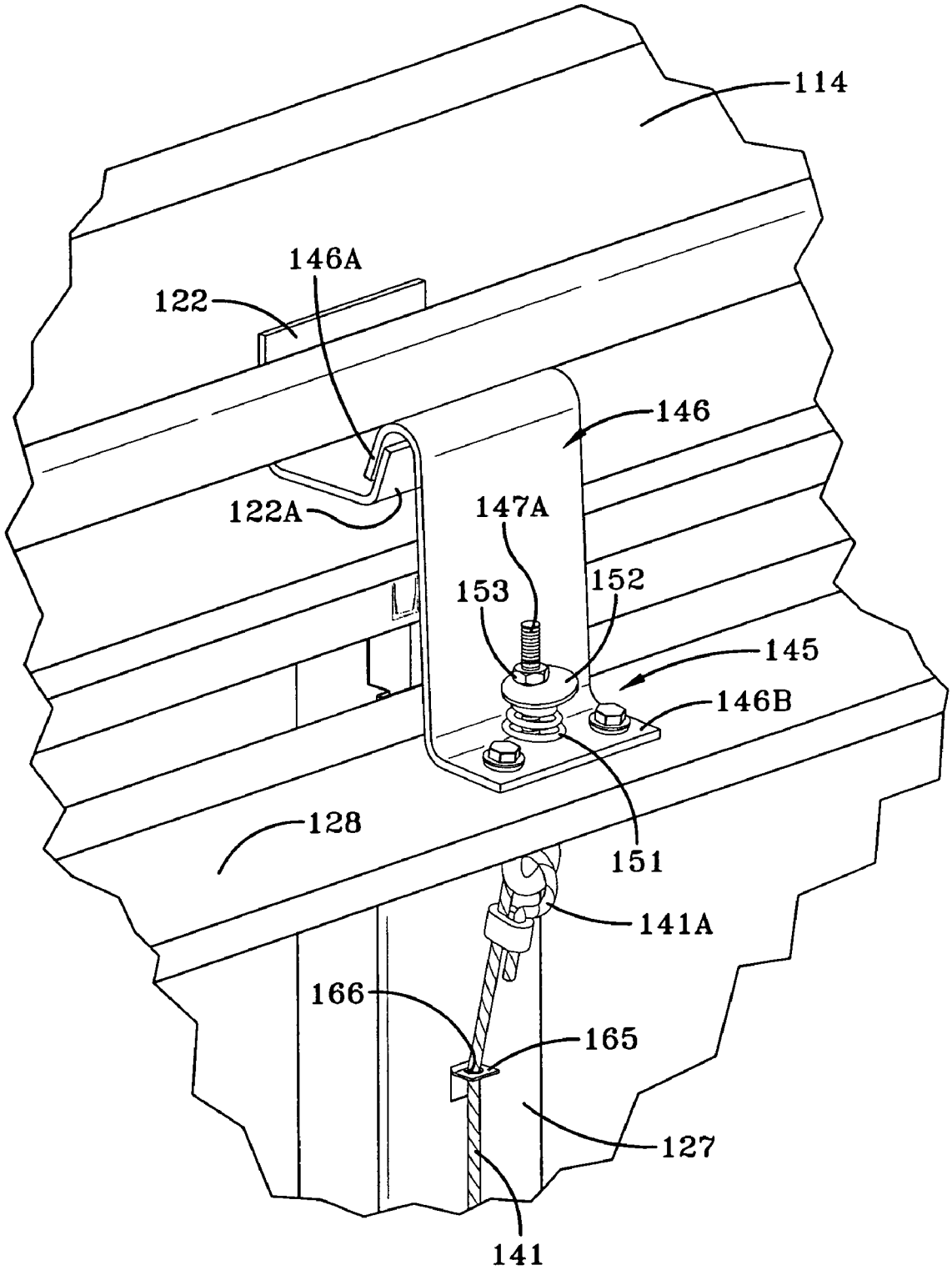
FIG. 6 is an enlarged rear perspective view of the area circled in FIG. 5 partially fragmented to show details of the alternate support system in an engaged position at the header.
Figure 9:
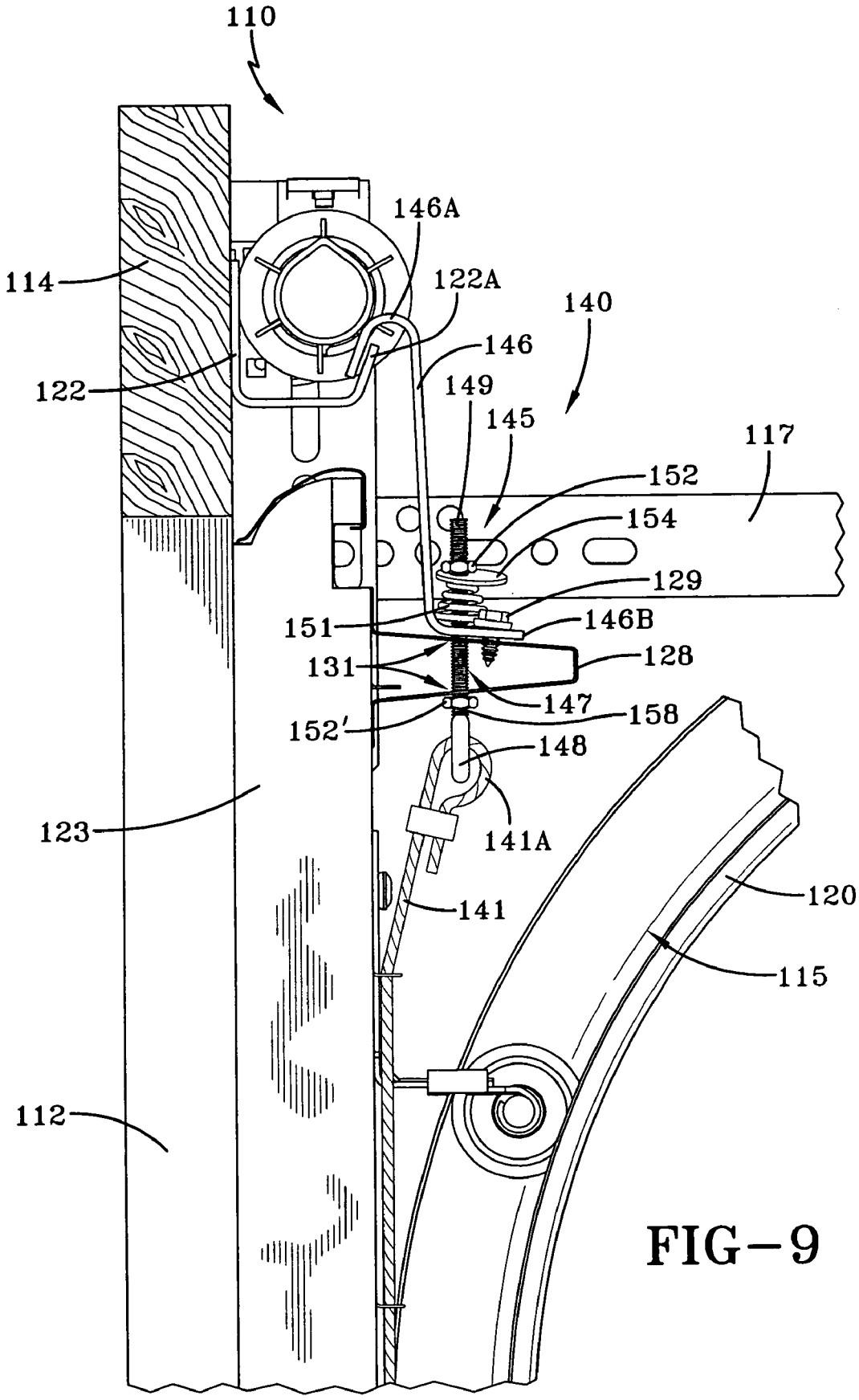
FIG. 9 is an enlarged and partially fragmented side elevational view, partially sectioned, showing details of the alternate support system near the header in a disengaged position.

As best shown in FIGS. 6 and 9, header attachment assembly 145 includes a bracket 146 having a lateral hook 146A at one end. An opposite bracket end 146B of the bracket 146 is mounted to the uppermost door section and in particular, a top side of the uppermost strut 128. Extending through the strut and the bracket end 146B is an opening 131. A plate 122 is mounted to the header 114 and an elongated, upwardly configured catch 122A extends from a bottom edge of the plate. Accordingly, the lateral hook 146A is adapted to overlap or otherwise engage the catch 122A when the door D is in the closed position (FIGS. 5, 6 and 9).

Header attachment assembly 145 further includes an eyebolt 147 that couples the support member 141 to the bracket 146. To that end, the eyebolt 147 may be provided with an eyelet 148 to which a loop 141A of the support member 141 attaches. An end 149 opposite the eyelet 148 extends upwardly and is slidably received through the opening 131. As shown in FIG. 9, the bracket 146 is secured to strut 128, as by a cap screw 129. A biasing member 151, which is in the form of a coil spring, is received on a shaft 158 of the eyebolt 147 that extends above the bracket end 146B. The spring may be any biasing member and attached in any suitable manner to provide a biasing force. In the example shown, the coil spring fits over the end 149 of eyebolt 147 and is located between the strut 128 and a stop 152, such as an internally threaded nut, threaded on the eyebolt 147. Stop 152 acts as a bearing surface for one end of the spring and transmits the force of the spring to the eyebolt 147. A washer 154 may be provided between the stop 152 and the spring to provide a large surface for contacting the spring 151. In the example shown, the spring tension may be adjusted by positioning the stop 152 at a desired axial position of the nut on the eyebolt 147. Optionally to provide another point of adjustment, a second stop 152', such as an internally threaded nut, may be threadably attached to the eyebolt 147 below the strut 128.

Figure 7:
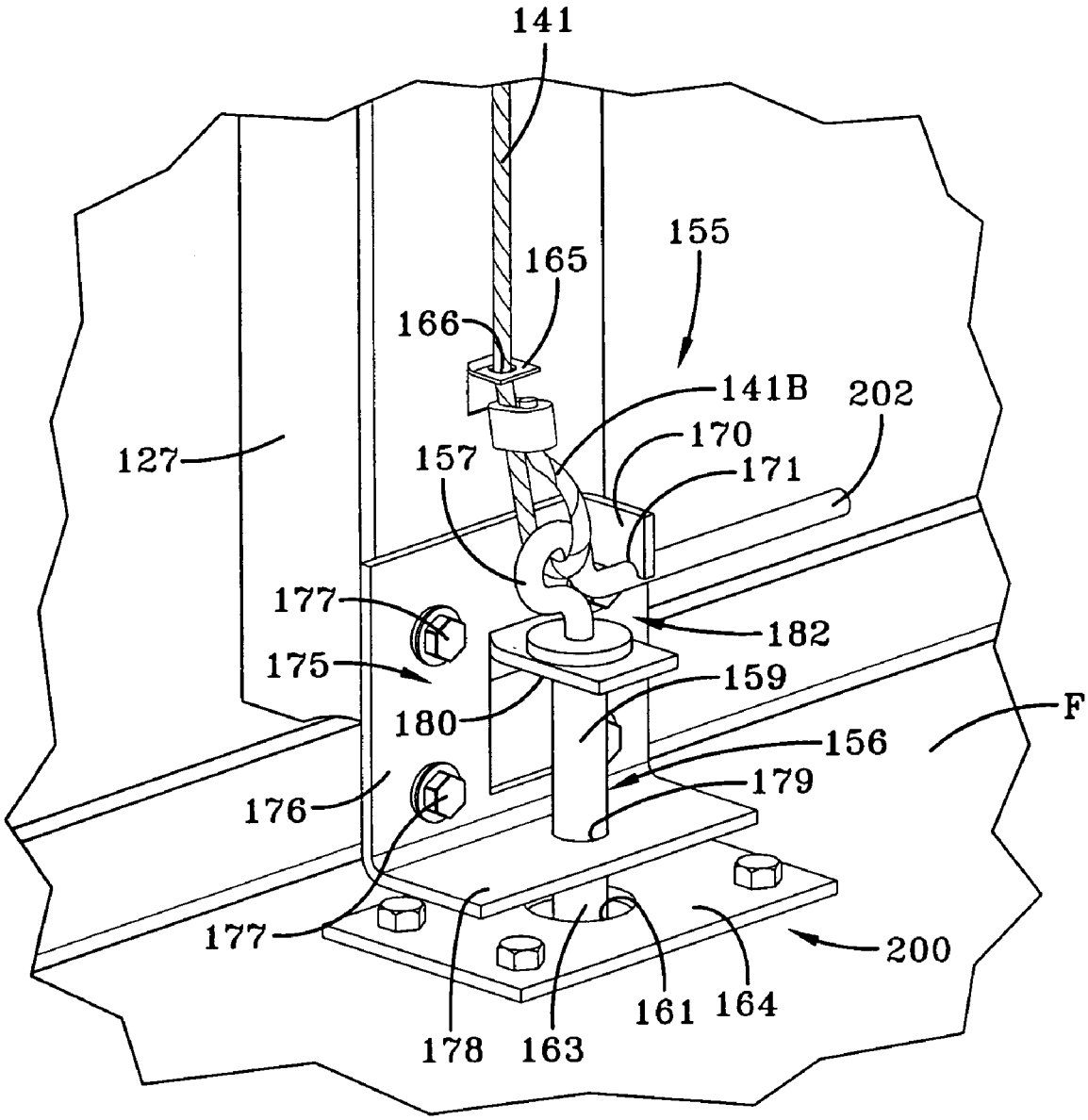
FIG. 7 is an enlarged rear perspective view of the area circled in FIG. 5 partially fragmented to show details of the attachment of the alternate support system in an engaged position at a floor that supports the door system.

As best shown in FIGS. 6 and 7, the flexible support member 141 extends from header attachment assembly 145 toward floor attachment assembly 155. As shown, the support member 141 may be guided along each door section 123, for example at a vertically extending stile 127 that may contain one or more guides 165 adapted to receive and position the support member 141 relative to the door D and assist in transferring stresses applied to the door. In the example shown, guides 165 define an opening 166 through which the support member 141 is slidably received. The guides 165 may be attached to the door D at a desired location or, as shown, formed as part of the door D or its component, for example a stile 127. For simplicity sake, both methods of providing guides on the door D can be used interchangeably. Of course, other structural configurations could be used to allow retained slidable movement of the support member in close proximity to the door sections.

As best shown in FIG. 7, an end of the flexible support member 141 attaches to the floor attachment assembly 155. The floor attachment assembly 155 includes an attachment member 156; a door section bracket, generally indicated by the numeral 175; and an attachment member receiver assembly 200. These three components—member 156, bracket 175 and receiver assembly generally indicated by the numeral 200—coact with one another and the header attachment assembly 145 to provide additional support to the door when it is in a closed position and the support system 140 is engaged.

The attachment member 156 includes a hook 157 at one end that receives and is coupled to a loop 141B formed in the support member 141. Other common methods of attachment could be used to secure the support member 141 to the hook 157. The attachment member 156 includes a shaft 159 that extends downwardly from the hook 157 through the door section bracket 175 into the receiver assembly 200. Specifically, the receiver assembly 200 includes a reinforcing plate 164 that is secured to the floor F by bolts, adhesives or other fastening devices. The plate 164 provides a bore 163 that is aligned with a bore 162 defined in the floor F of the structure in which the door D is located.

As shown, the door section bracket, generally indicated by the numeral 175, is attached to the lower edge of the lowermost door section 23 and, if provided, may be attached to a portion of the stile 127. Bracket 175 includes a bracket plate 176 that lies generally parallel to the door D and is fastened thereto, for example by bolts 177, and a guide leg 178 that extends substantially perpendicularly to and rearwardly with respect to the door from the bracket plate 176. The guide leg 178 provides a guide opening 179, which is aligned with the bore 163 and the bore 162, and which may slidably receive the shaft 159. Bracket 175 may further include a rearwardly extending shaft guide 180 that extends substantially perpendicularly from the bracket plate 176. The shaft guide 180 is located above the guide leg 178 and has a shaft opening 181 through which the shaft 159 is slidably and rotatably received. Also extending substantially perpendicularly from the bracket plate 176, and at a substantially perpendicular orientation with respect to the guide leg 178, is a catch 170. An underside edge of the catch 170, the edge facing the shaft guide 180, may include a semi-circular or other appropriately shaped cut-out 171. In the example shown, shaft guide 180 is located somewhat below the catch 170 defining a clearance, generally indicated by the numeral 182.

In this embodiment, the attachment member 156 includes an arm 202 that extends from hook 157 such that the arm 202 is substantially perpendicular to the shaft 159. As noted previously, the end 161 of shaft 159 may be received in a bore 163 formed in the floor F and/or a bore 163 formed in the reinforcing plate 164 attached to the floor F, as shown in FIG. 9. In the example shown, the catch 170 includes a cut-out 171 within which the outwardly projecting arm 202 of the attachment member 156 is received. The arm 202 extends laterally outward from the shaft 159 of the attachment member 156 and beyond the catch 170 to provide a suitable surface for manipulating the arm 202. In the example shown, to release or engage the floor attachment assembly 155 from catch 170, arm 202 is rotated about the axis of shaft 159, as described more completely below.

Figure 8:
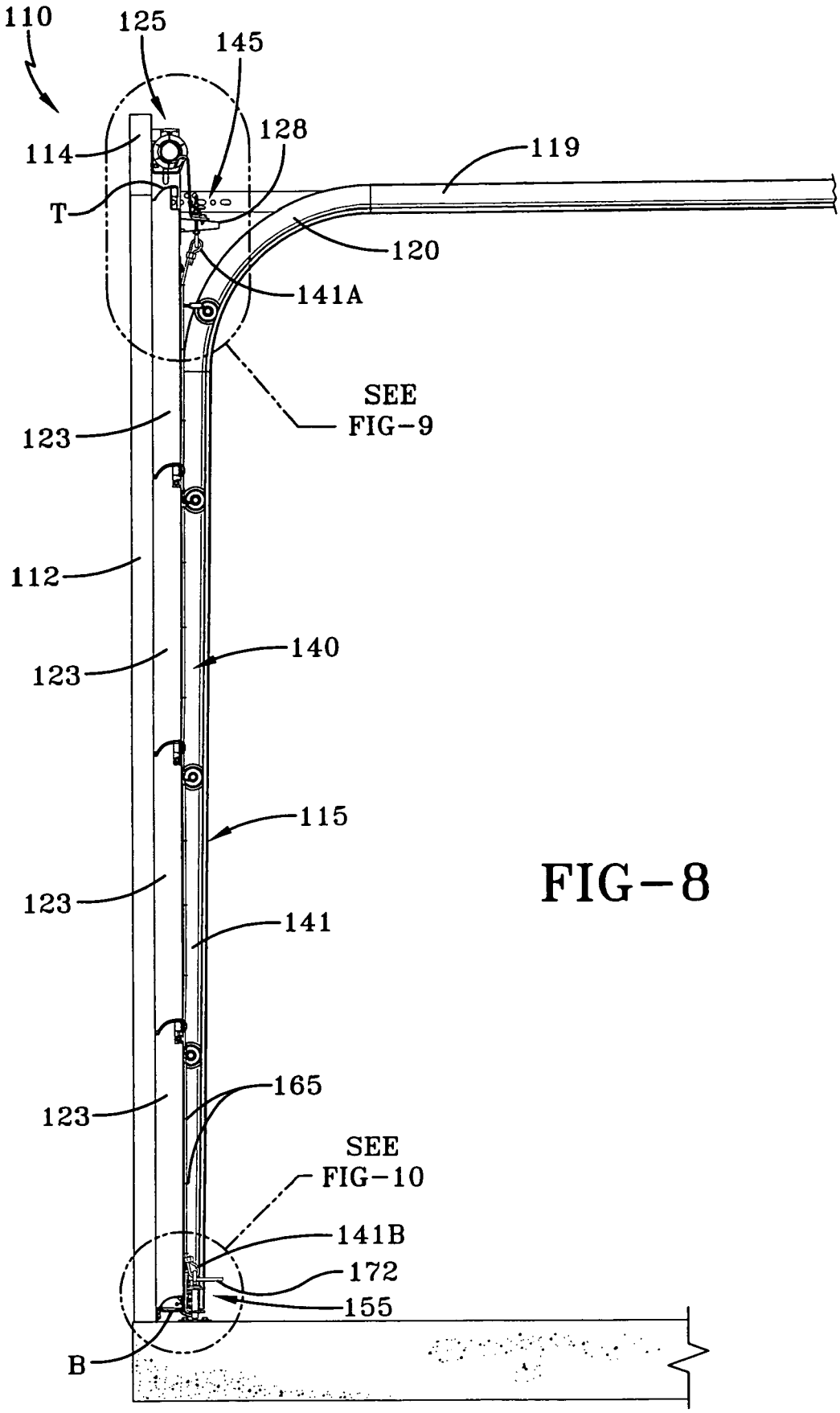
FIG. 8 is a left side elevational view of the door system depicting details of the alternate support system in a disengaged position.
Figure 10:
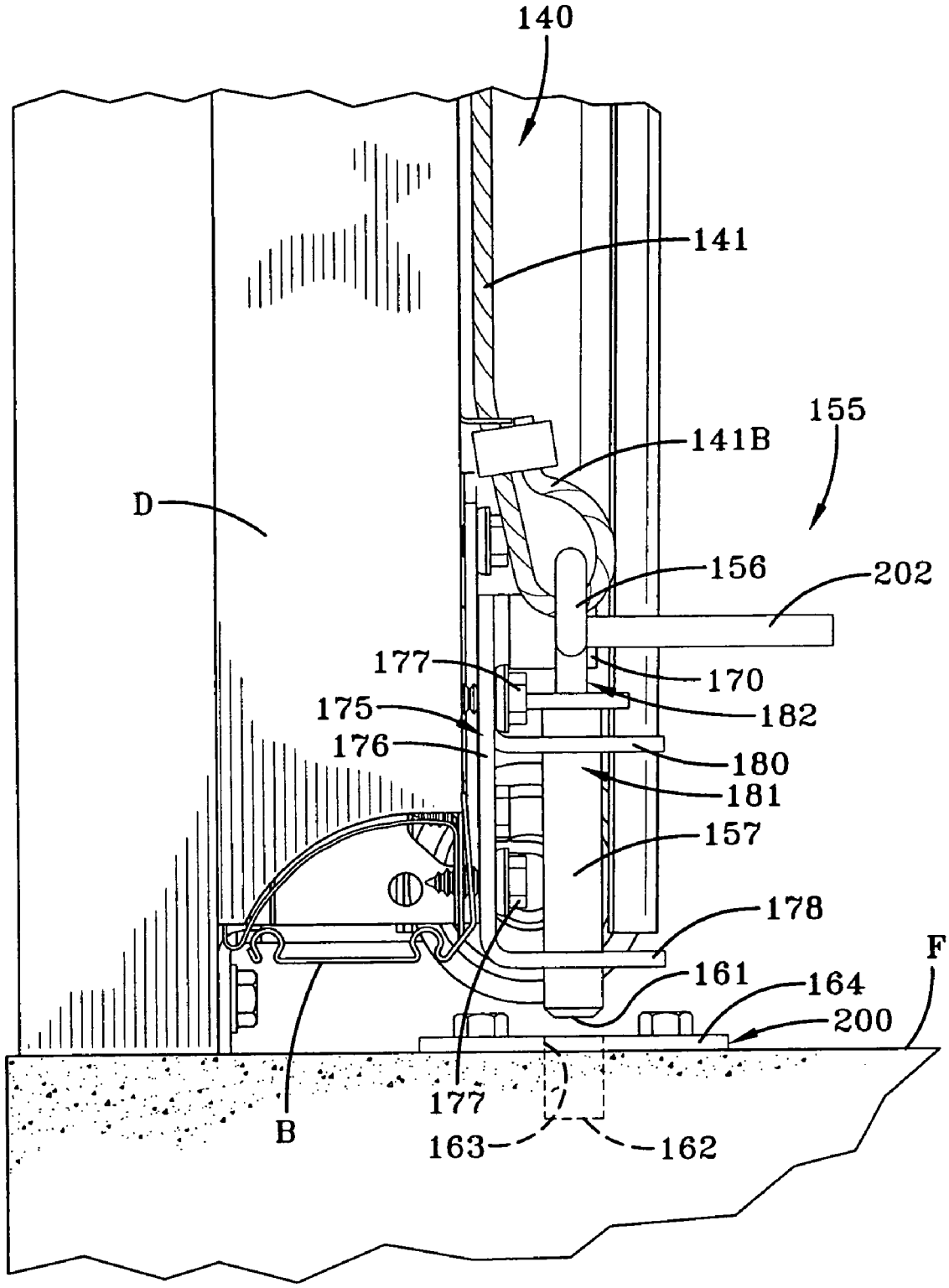
FIG. 10 is an enlarged and partially fragmented side elevational view, partially sectioned, showing details of the alternate support system near the floor in a disengaged position.

With reference to FIGS. 6-10, operation of the support system 140 will now be described. In FIG. 8, it can be seen that the door D is closed, and the door support system 140 is disengaged at the floor F (FIG. 10). In other words, the end 161 is not received in the bore 162 or the bore 163, and arm 202 is not engaged by the catch 170. In the disengaged configuration, the sectional door is allowed to be moved between limit positions. As such, the attachment member 156 and the section bracket 175 move with the bottom section of the door. As best shown in FIG. 9, after the door is moved into the closed position, the lateral hook 146A of bracket 146 overlaps and nests with catch 122A.

To engage the door support system 140, the arm 202 is urged downward so it may be rotated inward through clearance 181 and held beneath the catch as shown in FIG. 7. The cutout 171 may be used to receive the arm 172 and prevent its accidental release from the catch 170. The downward displacement of the floor attachment assembly 155 tensions and moves downwardly the support member 141 which, in turn, causes the biasing member 151 of header attachment assembly 145 to compress, as shown in FIG. 6. And, displacement of the arm 202 downward below the catch 170 causes the end 161 of shaft 159 to engage the floor F, for example by inserting the end 161 into a bore 163 formed in the floor F or the receiver 164. As in the previously described embodiment, when the support system is engaged, wind and other loads applied to the door D are transmitted through the support member 141 to the floor F and header 114.

Turning to FIG. 10, the support system 140 is disengaged when the arm 202 is rotated outward from the door D to clear the catch 170 and release it therefrom. With the floor attachment assembly released, the biasing member 151 urges the support member 141 upward drawing the end 161 of floor attachment assembly 155 out of engagement with the floor F and/or the receiver assembly 200.

Based upon the foregoing, the advantages of both embodiments described above are readily apparent. Namely, both embodiments allow for strengthening a garage door that does not rely on added beams and/or struts to stiffen the door. Embodiments presented strengthen the garage door by means that uniformly spread the stresses developed by wind velocity pressure over the width and height of the door and transfers the stresses to the structure of the building. Moreover, neither embodiment adds thickness to the door nor adds significant weight to the door. The disclosed embodiments are advantageous in that they add tensions to the sections in the direction along the width and the height of the door, or perpendicular to the force that is created by wind velocity pressure, but is directly proportional to the wind velocity pressure and allows the door some flexibility to expand or contract without buckling.

Yet another advantageous feature of both embodiments is that one person can install a garage door manufactured with the disclosed support systems in an easy and quick manner. Indeed, the disclosed embodiments function in a way so as to allow a sectional door to react similar to a rolling door in response to wind velocity pressures. The support system 40 is advantageous in that it can be used in conjunction with a pivoting operator and is automatically enabled upon closing of the garage door. In other words, pivoting of the motor operator assembly engages a header attachment assembly which in turn engages a floor attachment assembly. This is advantageous in that it allows for automatically engaging a support system whenever the door is closed. The support system 140, while providing many of the same benefits as the support system 40, is advantageous in that it is adaptable for any type of operator assembly. The support system 140 is engaged by manual activation, and as such, can be implemented whenever high wind conditions are expected. Although not ideal, it will be appreciated that engagement of the support system 140 while the door is closed and subsequent opening of the door will not provide or generate any damage to the door system.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto and thereby. Accordingly, for an appreciation of the true scope and breadth of the invention, reference should be made to the following claims.

What is claimed is:

1. A door system for a door opening defined by a pair of vertically oriented jambs, a header positioned near the vertical extremity of the jambs, and a floor supporting the jambs, the door system comprising:

a door;

a plurality of track sections, said door being moveable on said track sections;

a support system coupled to said door, wherein engagement of said support system when the door is in a closed position enables transfer of forces applied to said door to at least one of the header on the floor;

a pivotable operator motor assembly coupled to said door to move said door between open and closed positions, wherein at least a portion of said pivotable operator motor assembly pivots to a blocking position when said door is in said closed position;

a header attachment assembly coupled to a portion of said door and adapted to be coupled to the header, said support system engaged when said portion of said pivotable operator assembly pivots to the blocking position and engages said header attachment assembly;

a floor attachment assembly coupled to a portion of said door and adapted to be coupled to the floor;

a support member connected between said heater attachment assembly and said floor attachment assembly, wherein engagement of said header attachment assembly moves said support member and actuates said floor attachment assembly;

a header attachment member slidably retained by the door, said header attachment member having one end coupled to said support member;

a latch cam coupled to said header attachment member, wherein said portion of said motor assembly pivots and engages said latch cam when moved to the blocking position; and a cam spring biasing said latch cam with respect to the door with a cam biasing force, wherein said portion of said motor assembly pivots and engages said latch cam when moved to the blocking position and overcomes said cam biasing force.

2. The door system of claim 1, wherein said floor attachment assembly biasingly engages said door to the floor.

3. The door system of claim 1, further comprising:

a catch adapted to be mounted to the header, said catch having a catch hook; and a bracket mounted to a portion of said door, said bracket having a bracket hook, wherein said catch hook and said bracket hook nest with each other when the door is in the closed position.

4. The system of claim 1, wherein said floor attachment assembly comprises an attachment member moveable to an engaged position, and the floor adapted to have a bore which receives said attachment member when said support system is engaged.

5. The system of claim 1, wherein said floor attachment assembly comprises:

a floor attachment member slidably retained by said door, said floor attachment member having one end coupled to said support member;

a stop coupled to said floor attachment member, an end of said floor attachment member extending beyond said stop; and an engagement spring biasing said floor attachment member end with respect to the door with an engagement biasing force, wherein said engagement biasing force is no greater than said cam biasing force.

6. The system of claim 5, wherein the floor is adapted to have a bore, wherein compression of said cam spring by said latch cam allows said floor attachment member to engage said floor bore.

7. The system according to claim 1, wherein the door has at least one substantially horizontally oriented strut, said strut having a strut aperture therethrough, and wherein said support member is received through said strut aperture.

8. A method for operating a support system for a door that is moveable between open and closed positions with respect to a door opening, wherein the door opening is formed by a floor that supports a frame that provides a header substantially opposite the floor, the method comprising:

providing a header attachment assembly associated with an upper portion of the door and a floor attachment assembly associated with a lower portion of the door;

associating said header attachment assembly with said floor attachment assembly;

engaging one of said header or said floor assemblies so as to engage a support system to couple the door to at least one of the frame of the floor;

linking said attachment assemblies with a support member, wherein engagement of one said attachment assemblies moves said support member and engages the other of said attachment assemblies;

biasingly engaging one of said attachment assemblies to at least one of the header or the floor;

automatically actuating said support system; and moving the door between open and closed positions with a motor assembly, a portion of which pivots to a blocking position when the door reaches a closed position and actuates said support system.

9. The method according to claim 8, further comprising:

biasing both said attachment assemblies with respect to the door; and moving said portion of said motor assembly causes said biasing of said header attachment assembly to be overcome and allow further engagement with the header, and allow said biasing of said said floor attachment assembly to engage the floor.

* * * * *

UNITED STATES PATENT AND TRADEMARK OFFICE

CERTIFICATE OF CORRECTION

PATENT NO. : 7,469,737 B2
APPLICATION NO. : 11/493689
DATED : December 30, 2008
INVENTOR(S) : Willis J. Mullet and Allen C. McDowell It is certified that error appears in the above-identified patent and that said Letters Patent is hereby corrected as shown below:

Column 12, line 7 (Claim 1, line 6) the word “moveable” should read --movable--;
Column 12, line 12 (Claim 1, line 11) the word “on” should read --or--;
Column 12, line 21 (Claim 1, line 20) the words “operator assembly” should read --operator motor assembly--;
Column 12, line 25 (Claim 1, line 24) the word “heater” should read --header--;
Column 13, line 23 (Claim 8, line 13) the word “of” should read --or--;
Column 14, line 2 (Claim 8, line 15) the words “one said” should read --one of said--;
Column 14, line 18 (Claim 9, line 7) the words “said said” should read --said--.

Signed and Sealed this

Twenty-fourth Day of February, 2009

JOHN DOLL
*Acting Director of the United States Patent and Trademark Office*